US006112626A

United States Patent [19]

Risner et al.

[11] Patent Number: 6,112,626

[45] Date of Patent: Sep. 5, 2000

[54] TORQUE CONFIRMATION SOCKET SYSTEM

[76] Inventors: Ronald K. Risner; George E. Lowry, both of 6815 Harding Hwy., Lima, Ohio 45801

[21] Appl. No.: 09/265,298

[22] Filed: Mar. 9, 1999

Related U.S. Application Data

[60] Provisional application No. 60/077,505, Mar. 11, 1998.

[51] Int. Cl.[7] ..... B25B 23/145

[52] U.S. Cl. ..... 81/468; 401/195

[58] Field of Search ..... 81/468, 52.4, 52.5; 401/186, 193, 198, 260, 195

[56] References Cited

U.S. PATENT DOCUMENTS

| | | | |
|---|---|---|---|
| 2,901,934 | 9/1959 | Dunham | 81/468 |
| 3,009,371 | 11/1961 | Hines et al. . | |
| 3,113,336 | 12/1963 | Langnickel | 401/198 |
| 3,340,560 | 9/1967 | Nakata | 401/193 |
| 3,472,102 | 10/1969 | Dunlap et al. . | |
| 3,523,471 | 8/1970 | Lance . | |
| 3,662,629 | 5/1972 | Lance | 81/52.4 |
| 3,667,327 | 6/1972 | Lance . | |
| 3,774,479 | 11/1973 | Lesner . | |
| 4,053,243 | 10/1977 | Levin | 401/186 |

FOREIGN PATENT DOCUMENTS

| | | | |
|---|---|---|---|
| 406170742 | 6/1994 | Japan | 81/468 |

*Primary Examiner*—David A. Scherbel
*Assistant Examiner*—Hadi Shakeri
*Attorney, Agent, or Firm*—Jacox, Meckstroth & Jenkins

[57] ABSTRACT

An elongated socket tool includes a tubular socket member having a cavity for receiving a hexagonal threaded fastener and a drive member having a recess for receiving the square drive stud projected from a torque wrench. The socket member and the drive member are welded to opposite ends of a tubular metal body which also defines a chamber for receiving a marking fluid. A flow restrictor plate is welded between the body and the socket member and has orifices which control the flow of marking fluid from the chamber into a cylindrical wick confined within the socket member. A removable flexible cap normally covers the socket member when the socket tool is not in use.

3 Claims, 1 Drawing Sheet

TORQUE CONFIRMATION SOCKET SYSTEM

RELATED APPLICATION

This application claims the benefit of Provisional Application Ser. No. 60/077,505, filed Mar. 11, 1998.

BACKGROUND OF THE INVENTION

In the assembly of various mechanism including components for automobiles, it is common to use threaded fasteners which must be tightened to a predetermined torque. Frequently, it is also desirable to mark the threaded fastener, such as a hex head screw or hex shaped nut, when the fastener has received a torque wrench, thereby indicating that the fastener has been properly tightened to the desired torque. One method of marking such a fastener is by inserting a felt pad within the bottom of a female socket and then squirting a colored ink onto the pad so that the ink is deposited on the fastener when the socket is inserted onto the fastener. However, this method is messy and requires that the marking ink be frequently applied to the felt pad inserted within the socket, thus requiring additional time for tightening and marking a high volume of fasteners to a predetermined torque. Other forms of torque wrenches with bolt marking devices are disclosed in U.S. Pat. No. 3,009,371, No. 3,472,102, No. 3,523,471, No. 3,667,327 and No. 3,774,479.

SUMMARY OF THE INVENTION

The present invention is directed to an improved socket system or tool which is adapted for use with a conventional hand operated torque wrench and which provides a verification or confirmation on the end of a threaded fastener when a torque wrench has been applied to the fastener. In accordance with a preferred embodiment of the invention, an elongated cylindrical socket tool has a tubular socket member on one end for receiving a threaded fastener and a drive member with a square hole on the opposite end for receiving the drive output stud of a torque wrench. An intermediate tubular or hollow portion of the socket tool defines a reservoir chamber for receiving a marking fluid such as an ink which is supplied to the reservoir through a port within the wall of the tubular portion. A flow restrictor plate is disposed between the tubular portion and the socket member and has small orifices through which the marking fluid passes from the reservoir to saturate a cylindrical felt wick inserted into the socket member.

When the socket tool is placed on a threaded fastener, the felt wick marks the end surface of the fastener to indicate that the fastener has received the socket tool and the attached torque wrench. The marking fluid reservoir provides for marking many hundreds of fasteners before refilling is required, and the marking fluid within the wick is prevented from drying when the socket tool is not in use by placing a removable vinyl cap over the end portion of the socket.

Other features and advantages of the invention will be apparent from the following description, the accompanying drawing and the appended claims.

DESCRIPTION OF THE PREFERRED EMBODIMENT

Figure 1:
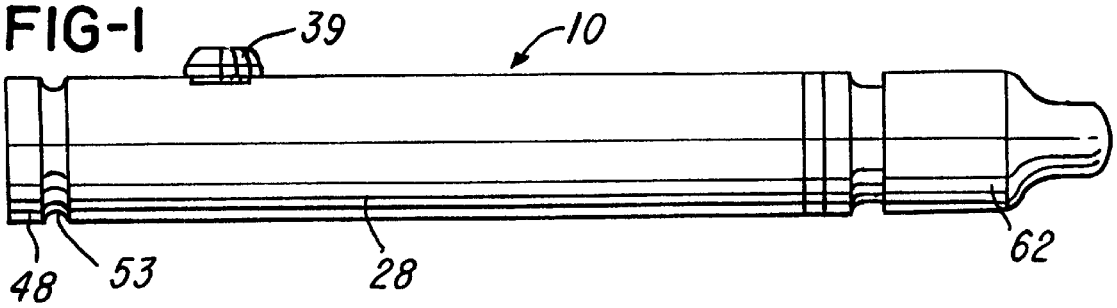
FIG. 1 is a side elevational view of a socket system or tool constructed in accordance with the invention.
Figure 2:
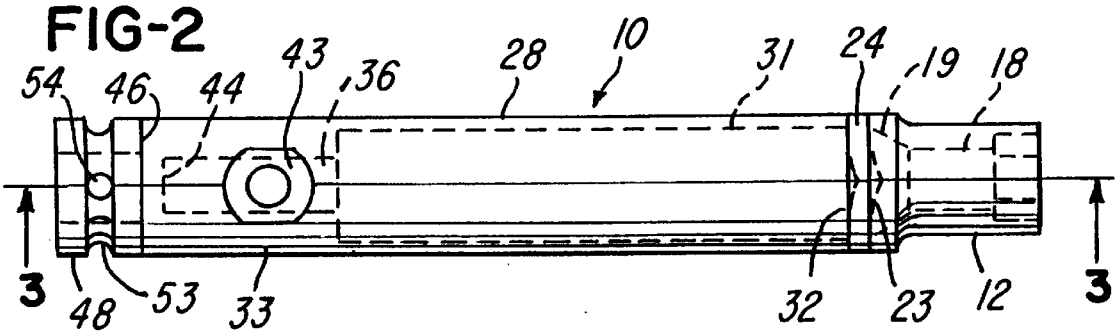
FIG. 2 is a top view of the socket tool shown in FIG. 1 and illustrating the construction of the socket unit.
Figure 3:
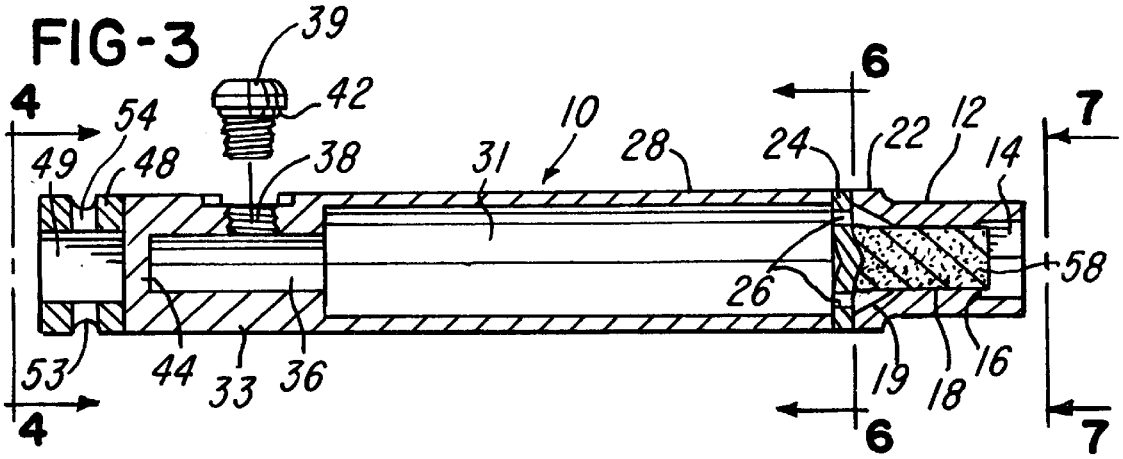
FIG. 3 is an axial section of the socket tool, taken generally on the line 3—3 of FIG. 2.
Figure 4:
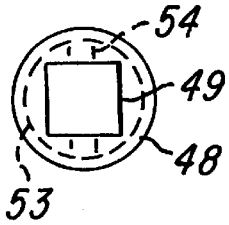
FIG. 4 is an end view of the socket tool, taken generally on the line 4—4 of FIG. 3.

A socket unit or tool 10 shown in FIGS. 1–3 is constructed of metal, preferably steel, and includes a tubular socket member 12 defining a hexagonal socket or recess 14 extending from an internal shoulder 16. The socket member 12 defines a cylindrical chamber 18 which extends to a tapered or frusto-conical chamber 19. The socket member 12 has an outwardly projecting flange portion 22 which is welded circumferentially at 23 to one side of a circular flow restrictor plate 24 defining a pair of orifices or passages 26.

An elongated cylindrical socket body 28 has a cylindrical bore which defines a reservoir chamber 31, and one end of the body 28 is welded circumferentially at 32 to the other side of the flow restrictor plate 24. The socket body 28 has a closed end portion 33 which has a thicker wall and defines a reservoir extension chamber 36. The body portion 33 has a threaded radial fill hole 38 which is closed by a pan head screw 39 having a hexagonal recess. A resilient O-ring 42 is mounted on the screw 39 and engages a flat spotface 43 (FIG. 2) on the socket body portion 33 when the screw 39 is threaded into the hole 38 and tightened to form a fluid tight seal.

The socket body 28 has a closed end wall 44 which is welded circumferentially at 46 to a drive end portion 48 defining a square opening 49. A circumferential groove 53 is formed around the drive end portion 48 and is adapted to receive a resilient O-ring (not shown) for retaining a cross pin (not shown) adapted to extend through a cross hole 54 within the drive head portion 48. The cross pin locks the tool 10 to the drive stud of a hand operated torque wrench. The drive end or head portion 48 and the socket member 12 are formed by cutting a commercially available socket in half or into the two pieces.

Figure 5:
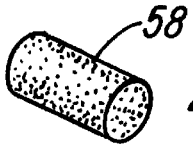
FIG. 5 is a perspective view of the cylindrical felt wick used in the socket tool as shown in FIG. 3.
Figure 6:
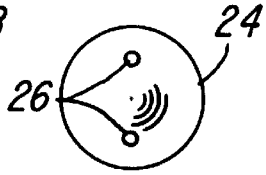
FIG. 6 is an axial view of the marking fluid flow restrictor plate shown in FIG. 3.
Figure 7:
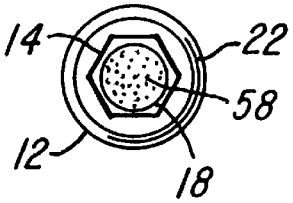
FIG. 7 is an end view of the tool, taken generally on the line 77 of FIG. 3.

Referring to FIG. 5, a cylindrical felt wick 58 is inserted into the chamber 18 of the socket member 12. One end of the wick 58 engages and is stopped by the restrictor plate 24, and the opposite end portion of the wick 58 projects partially or slightly into the hexagonal socket recess 14.

In operation of the socket tool 10, the reservoir chambers 31 and 36 are filled with a marking fluid or liquid, such as an ink, dye or paint, through the opening 38 after the screw 39 is removed and the wick 58 is inserted into the socket member 12. The orifices 26 within the restrictor plate 24 permit the marking fluid to saturate the wick 58, and a molded vinyl cap 62 is pressed lightly onto the socket member 12 to prevent the marking fluid from evaporating from the wick 58 or drying within the wick when the socket tool 10 is not in use.

When it is desired to tighten a threaded fastener, such as a hex head bolt or a hex shaped nut, to a predetermined torque, the drive end portion 48 of the tool 10 is inserted onto the square drive stud or stem of a manually actuated torque wrench (not shown). The vinyl cap 62 is removed, and the socket member 12 is placed on the threaded fastener so that the wick 58 deposits the ink or other marking fluid only on the end surface of the fastener. When the torque wrench and tool 10 are removed from the fastener, the end surface of the fastener carries a visible indication or mark which confirms that the assembly of the torque wrench and socket tool 10 has been placed on the fastener.

In a typical application or use of the socket tool 10 attached to a torque wrench, several hundred fasteners may be tightened and marked during each day of use. As a result of the substantial volume of marking fluid which may be enclosed in the reservoir chambers 31 and 36, the socket tool 10 may be used for marking several thousand fasteners before refilling the chambers with the marking fluid. This provides for high speed tightening and marking of the fasteners, which is highly desirable in many applications such as on the assembly line of an automobile component.

The felt wick 58 may also be conveniently removed with a pair of needle-nose pliers for cleaning the wick or replacing the wick. The socket tool 10 also prevents any leakage of the marking fluid and may be used in any position or attitude for marking the ends of fasteners regardless of the position of the fasteners which are to be tightened. Depending upon the viscosity of the marking fluid, the holes 26 within the restrictor plate 24 may be sized according to the desired seepage through the orifices 26 into the wick 58 and to prevent dripping or seeping of the marking fluid from the wick 58 and into the socket head recess 14.

While the form of socket tool and its method of construction herein described constitutes a preferred embodiment of the invention, it is to be understood that the invention is not limited to this precise form of tool and method, and that changes may be made therein without departing from the scope and spirit of the invention as defined in the appended claims.

We claim:

1. A socket system for tightening a series of threaded fasteners and for marking the fasteners to indicate that the fasteners have been tightened, said system comprising an elongated metal body having a first end portion and an opposite second end portion and defining a fluid chamber receiving a marking fluid, a tubular socket member welded to said first end portion of said body and defining a cavity adapted to receive and engage the threaded fastener, a drive member welded to said second end portion of said body and defining a recess adapted to receive a square drive stud projecting from a torque wrench, a metal flow restrictor plate disposed between said body and said socket member and having a peripheral portion welded to said body and said socket member, a wick member of porous material disposed within said socket member and extending from said restrictor plate into said cavity, said restrictor plate having at least one orifice to permit a controlled flow of said marking fluid from said chamber into said wick member, said body having an opening for adding said marking fluid to said chamber, and a removable closure for said opening.

2. A socket system as defined in claim 1 wherein said socket member and said drive member comprise a first end portion separated from a second end portion of a one piece metal drive socket.

3. A socket system as defined in claim 1 and including a flexible cap press-fitted on said socket member and covering said cavity to prevent evaporation of the marking fluid.

* * * * *